US009094771B2

(12) United States Patent
Tsingos et al.

(10) Patent No.: US 9,094,771 B2
(45) Date of Patent: Jul. 28, 2015

(54) METHOD AND SYSTEM FOR UPMIXING AUDIO TO GENERATE 3D AUDIO

(75) Inventors: Nicolas R. Tsingos, Palo Alto, CA (US); Charles Q. Robinson, Piedmont, CA (US); Christophe Chabanne, Carpentras (FR); Toni Hirvonen, Upplands Väsby (SE); Patrick Griffis, Sunnyvale, CA (US)

(73) Assignees: Dolby Laboratories Licensing Corporation, San Francisco, CA (US); Dolby International AB, Amsterdamm (NL)

( * ) Notice: Subject to any disclaimer, the term of this patent is extended or adjusted under 35 U.S.C. 154(b) by 179 days.

(21) Appl. No.: 14/111,460

(22) PCT Filed: Apr. 5, 2012

(86) PCT No.: PCT/US2012/032258

§ 371 (c)(1),
(2), (4) Date: Oct. 11, 2013

(87) PCT Pub. No.: WO2012/145176

PCT Pub. Date: Oct. 26, 2012

(65) Prior Publication Data

US 2014/0037117 A1 Feb. 6, 2014

Related U.S. Application Data

(60) Provisional application No. 61/476,395, filed on Apr. 18, 2011.

(51) Int. Cl.
*H04S 7/00* (2006.01)
*H04S 5/00* (2006.01)

(52) U.S. Cl.
CPC ..... *H04S 7/302* (2013.01); *H04S 5/005* (2013.01); *H04S 2400/11* (2013.01); *H04S 2400/13* (2013.01); *H04S 2420/05* (2013.01)

(58) Field of Classification Search
CPC ..... H04S 7/301; H04S 7/302; H04S 2420/01; H04S 7/00; H04S 7/30; H04S 7/303
USPC ..... 381/303
See application file for complete search history.

(56) References Cited

U.S. PATENT DOCUMENTS 5,438,623 A 8/1995 Begault
5,754,660 A 5/1998 Shimizu (Continued)

FOREIGN PATENT DOCUMENTS

GB 2340005 2/2000
JP H07-236199 9/1995

(Continued)

OTHER PUBLICATIONS

Min, D. et al. "Temporally Consistent Stereo Matching Using Coherence Function", Mitsubishi Electric Research Laboratories, TR2010, IEEE, Jul. 2010.

(Continued)

*Primary Examiner* — Mark Blouin

(57) ABSTRACT

In some embodiments, a method for upmixing input audio comprising N full range channels to generate 3D output audio comprising N+M full range channels, where the N+M full range channels are intended to be rendered by speakers including at least two speakers at different distances from the listener. The N channel input audio is a 2D audio program whose N full range channels are intended for rendering by N speakers nominally equidistant from the listener. The upmixing of the input audio to generate the 3D output audio is typically performed in an automated manner, in response to cues determined in automated fashion from stereoscopic 3D video corresponding to the input audio, or in response to cues determined in automated fashion from the input audio. Other aspects include a system configured to perform, and a computer readable medium which stores code for implementing any embodiment of the inventive method.

15 Claims, 2 Drawing Sheets

(56) References Cited

U.S. PATENT DOCUMENTS

| | | | | |
|---|---|---|---|---|
| 6,931,134 | B1 | 8/2005 | Waller, Jr. | |
| 7,215,782 | B2 | 5/2007 | Chen | |
| 7,440,578 | B2 | 10/2008 | Arai | |
| 7,558,393 | B2 | 7/2009 | Miller | |
| 7,684,577 | B2 | 3/2010 | Arai | |
| 8,472,632 | B2 * | 6/2013 | Riedel et al. | 381/56 |
| 8,681,997 | B2 * | 3/2014 | Karaoguz | 381/17 |
| 8,861,751 | B2 * | 10/2014 | Misaki et al. | 381/123 |
| 8,942,395 | B2 * | 1/2015 | Lissaman et al. | 381/303 |
| 9,031,268 | B2 * | 5/2015 | Fejzo et al. | 381/303 |
| 2003/0007648 | A1 | 1/2003 | Currell | |
| 2003/0053680 | A1 | 3/2003 | Lin | |
| 2004/0032796 | A1 | 2/2004 | Chu | |
| 2006/0050890 | A1 | 3/2006 | Tsuhako | |
| 2006/0117261 | A1 | 6/2006 | Sim | |
| 2009/0034764 | A1 | 2/2009 | Ohashi | |
| 2009/0080666 | A1 | 3/2009 | Uhle | |
| 2009/0092259 | A1 | 4/2009 | Jot | |
| 2009/0122161 | A1 | 5/2009 | Bolkhovitinov | |
| 2010/0272417 | A1 | 10/2010 | Nagasawa | |

FOREIGN PATENT DOCUMENTS

| | | |
|---|---|---|
| JP | H08-140200 | 5/1996 |
| JP | 2003-087893 | 3/2003 |
| JP | 2011-035784 | 2/2011 |
| JP | 2011-254359 | 12/2011 |
| WO | 97/43856 | 11/1997 |
| WO | 2006/091540 | 8/2006 |
| WO | 2008/075276 | 6/2008 |

OTHER PUBLICATIONS

Achanta, R. et al. "Salient Region Detection and Segmentation", 6th International Conference in Computer Vision Systems (ICVS08), Greece, May 2008.

Ekstrand, Per "Bandwidth Extension of Audio Signals by Spectral Band Replication" Proc. 1st IEEE Benelux Workshop on Model Based Processing and Coding of Audio, Leuven, Belgium, Nov. 15, 2002, pp. 53-58.

Herre, J. et al. "MPEG Surround—The ISO/MPEG Standard for Efficient and Compatible Multichannel Audio Coding", J. Audio Eng. Soc. vol. 56, No. 1, pp. 932-955, Nov. 2008.

Pulkki, V. "Spatial Sound Reproduction with Directional Audio Coding" JAES vol. 55, pp. 503-516, Jun. 2007.

A.S. Master, Stereo Music Source Separation via Bayesian Modeling, Ph.D. Dissertation Stanford University, Jun. 2006.

Gundry, Kenneth, "A New Active Matrix Decoder for Surround Sound", AES Conference: 19th International Conference: Surround Sound—Techniques, Technology, and Perception, Jun. 2001.

Mendiburu, Bernard, 3D Movie Making: Stereoscopic Digital Cinema from Script to Screen Focal Press: May 6, 2009.

Bay, H. et al. "SURF: Speeded Up Robust Features", Computer Vision and Image Understanding (CVIU), vol. 110, No. 3, pp. 346-359, 2008.

Komiyama, S. et al. "A Loudspeaker-Array to Control Sound Image Distance" Acoust. Sci. & Tech. 24, 5, pp. 242-249, Sep. 2003.

Komiyama, S. et al. "Distance Control of Sound Images by a Two-Dimensional Loudspeaker Array" Journal of the Acoustical Society of Japan, v. 13, No. 3, pp. 171-180, May 1992.

Potard, Guillaume "3D-Audio Object Oriented Coding" University of Wollongong Thesis Collections, 2006.

Yu, F. et al. "A Comparison of Software Tools for the Implementation of Spatial Sounds in Virtual Environments" Canadian Acoustics, v. 28, n. 3, pp. 74-75, Sep. 2000.

* cited by examiner

METHOD AND SYSTEM FOR UPMIXING AUDIO TO GENERATE 3D AUDIO

CROSS-REFERENCE TO RELATED APPLICATIONS

This application claims priority to U.S. Patent Provisional Application No. 61/476,395, filed 18 Apr. 2011, hereby incorporated by reference in its entirety.

BACKGROUND OF THE INVENTION

1. Field of the Invention

The invention relates to systems and methods for upmixing multichannel audio to generate multichannel 3D output audio. Typical embodiments are systems and methods for upmixing 2D input audio (comprising N full range channels) intended for rendering by speakers that are nominally equidistant from a listener, to generate 3D output audio comprising N+M full range channels, where the N+M full range channels are intended to be rendered by speakers including at least two speakers at different distances from the listener.

2. Background of the Invention

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X−M inputs are received from an external source) may also be referred to as a decoder system.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel: an audio signal that is rendered in such a way as to be equivalent to application of the audio signal directly to a loudspeaker at a desired or nominal position. The desired position can be static, as is typically the case with physical loudspeakers, or dynamic;

audio program: a set of one or more audio channels;

render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis;

stereoscopic 3D video: video which, when displayed, creates a sensation of visual depth using two slightly different projections of a displayed scene onto the retinas of the viewer's two eyes;

azimuth (or azimuthal angle): the angle, in a horizontal plane, of a source relative to a listener/viewer. Typically, an azimuthal angle of 0 degrees denotes that the source is directly in front of the listener/viewer, and the azimuthal angle increases as the source moves in a counter clockwise direction around the listener/viewer;

elevation (or elevational angle): the angle, in a vertical plane, of a source relative to a listener/viewer. Typically, an elevational angle of 0 degrees denotes that the source is in the same horizontal plane as the listener/viewer, and the elevational angle increases as the source moves upward (in a range from 0 to 90 degrees) relative to the viewer;

L: Left front audio channel. Typically intended to be rendered by a speaker positioned at about 30 degrees azimuth, 0 degrees elevation;

C: Center front audio channel. Typically intended to be rendered by a speaker positioned at about 0 degrees azimuth, 0 degrees elevation;

R: Right front audio channel. Typically intended to be rendered by a speaker positioned at about −30 degrees azimuth, 0 degrees elevation;

Ls: Left surround audio channel. Typically intended to be rendered by a speaker positioned at about 110 degrees azimuth, 0 degrees elevation;

Rs: Right surround audio channel. Typically intended to be rendered by a speaker positioned at about −110 degrees azimuth, 0 degrees elevation;

Full Range Channels: All audio channels of an audio program other than each low frequency effects channel of the program. Typical full range channels are L and R channels of stereo programs, and L, C, R, Ls and Rs channels of surround sound programs. The sound determined by a low frequency effects channel (e.g., a subwoofer channel) comprises frequency components in the audible range up to a cutoff frequency, but does not include frequency components in the audible range above the cutoff frequency (as do typical full range channels);

Front Channels: audio channels (of an audio program) associated with frontal sound stage. Typical front channels are L and R channels of stereo programs, or L, C and R channels of surround sound programs;

2D audio program (e.g., 2D input audio, or 2D audio): an audio program comprising at least one full range channel (typically determined by an audio signal for each channel), intended to be rendered by speaker(s) that are nominally equidistant from the listener (e.g., two, five, or seven speakers that are nominally equidistant from the listener, or one speaker). The program is "intended" to be rendered by speakers that are nominally equidistant from the listener in the sense that the program is generated (e.g., by recording and mastering, or any other method) such that when its full range channels are rendered by equidistant speakers positioned at appropriate azimuth and elevation angles relative to the listener (e.g., with each speaker at a different predetermined azimuth angle relative to the listener), the emitted sound is perceived by the listener with a desired imaging of perceived audio sources. For example, the sound may be perceived as originating from sources at the same distance from the listener as are the speakers, or from sources in a range of different distances from the listener. Examples of conventional 2D audio programs are stereo audio programs and 5.1 surround sound programs;

3D audio program (e.g., 3D output audio, or 3D audio): an audio program whose full range channels include a first channel subset comprising at least one audio channel (sometimes referred to as a "main" channel or as "main" channels) that determine a 2D audio program (intended to be rendered by at least one "main" speaker, and typically by at least two "main" speakers, that are equidistant from the listener), and also a second channel subset comprising at least one audio channel intended to be rendered by at least one speaker positioned physically closer to or farther from the listener than are the speaker(s) ("main" speaker(s)) which render the main channel(s). The second channel subset may include at least one audio channel (sometimes referred to herein as a "near" or "nearfield" channel) intended to be rendered by a speaker (a "near" or "nearfield" speaker) positioned physically closer to the listener than are the main speakers, and/or at least one audio channel (sometimes referred to herein as a "far" or "farfield" channel) intended to be rendered by a speaker positioned physically farther from the listener than are the main speakers. The program is "intended" to be rendered by the speakers in the sense that the program is generated (e.g., by recording and mastering, or any other method) such that when its full range channels are rendered by the speakers positioned at appropriate azimuth and elevation angles relative to the listener, the emitted sound is perceived by the listener with a desired imaging of perceived audio sources. For example, the sound may be perceived as originating from sources in the same range of distances from the listener as are the speakers, or from sources in a range of distances from the listener that is wider or narrower than the range of speaker-listener distances. A "near" (or "far") channel of a 3D audio program that is "intended" to be rendered by a near speaker that is physically closer to (or a far speaker physically farther from) the listener than are the main speakers, may actually be rendered (trivially) by such a physically nearer (or farther) speaker, or it may be "virtually" rendered (e.g., using any of a number of techniques including transaural or wave field synthesis) using speaker(s) at any physical distance(s) from the listener in a manner designed to be at least substantially equivalent to the trivial rendering. One example of rendering of the full range channels of a 3D audio program is rendering with each main speaker at a different predetermined azimuthal angle relative to the listener, and each nearfield and farfield speaker at an azimuthal angle that is at least substantially equal to zero;

Spatial Region: a portion of a visual image which is analyzed and assigned a depth value; and AVR: an audio video receiver. For example, a receiver in a class of consumer electronics equipment used to control playback of audio and video content, for example in a home theater.

Stereoscopic 3D movies are becoming increasingly popular and already account for a significant percentage of today's box office revenue in the US. New digital cinema, broadcast and Blu-ray specifications allow 3D movies and other 3D video content (e.g., live sports) to be distributed and rendered as distinct left and right eye images using a variety of techniques including polarized glasses, full spectrum chromatic separation glasses, active shutter glasses, or auto stereoscopic displays that do not require glasses. The infrastructure for creation, distribution and rendering of stereoscopic 3D content in theaters as well as homes is now in place.

Stereoscopic 3D video adds depth impression to the visual images. Displayed objects can be rendered so as to appear to be at varying distances from the user, from well in front to far behind the screen. The accompanying soundtracks (typically surround soundtracks) are currently authored and rendered using the same techniques as for 2D movies. A conventional 2D surround soundtrack typically includes five or seven audio signals (full range channels) that are routed to speakers that are nominally equidistant to the listener and placed at different nominal azimuth angles relative to the listener.

For example, FIG. 1 shows a conventional five-speaker sound playback system for rendering a 2D audio program for listener 1. The 2D audio program is a conventional five-channel surround sound program. The system includes speakers 2, 3, 4, 5, and 6 which are at least substantially equidistant from listener 1. Each of speakers 2, 3, 4, 5, and 6 is intended for use in rendering a different full range channel of the program. As indicated, speaker 3 (intended for rendering a right front channel of the program) is positioned at an azimuthal angle of 30 degrees, speaker 6 (intended for rendering a right surround channel of the program) is positioned at an azimuthal angle of 110 degrees, and speaker 4 (intended for rendering a center front channel of the program) is positioned at an azimuthal angle of 0 degrees.

In free-field (without reflections), a listener's perception of audio source distance is guided primarily by three cues: the auditory level, the relative level of high and low frequency content, and for near field signals, the level disparity between the listener's ears. For a familiar sound such as speech uttered (or assumed to have been uttered) at a typical emission level, the auditory level is by far the most important cue. If the listener does not have knowledge of the emission level of perceived audio, the perceived auditory level is less useful and the other cues come into play. In a reverberant acoustic environment there are additional cues (to the distance of the audio source from the listener) including direct to reverb ratio, and level and direction of early reflections.

For audio signals reproduced in a home listening room, cinema or theater, a "dry" or unprocessed signal rendered from a traditional loudspeaker will generally image at the loudspeaker distance. In creating a 2D audio program (e.g., surround soundtrack), farness (perception of sound from a distant source) can be simulated using well-known mixing techniques (e.g., reverb and low pass filtering). There is no effective mixing method for producing a 2D audio program which simulates nearness (beyond implicit contrast with audio from a simulated far source), in part because it is very difficult to remove or suppress the natural reverb of the playback venue.

Hardware-based systems for rendering 3D audio (near audio images as well as audio perceived to be from sources farther from the listener) have been proposed. In such systems audio is rendered by a first set of speakers (including at least one speaker) positioned relatively far from the listener and a second set of speakers (including at least one speaker, e.g., a set of headphones) positioned closer to the listener. Typically, the speakers in the first set are time-aligned with the speakers in the second set. An example of such a system is described in US Patent Application Publication No. 2006/0050890 by Tsuhako, published on Mar. 9, 2006. A system in this class could render a 3D audio program. Although such a 3D audio program could be generated specially for rendering by such a system, until the present invention it had not been proposed to generate such a 3D audio program by upmixing a 2D audio program. Nor had it been known (until the present invention)

how to perform upmixing on a 2D audio program to generate a 3D audio program, e.g., for rendering by a system in the class discussed this paragraph.

A number of technologies have been proposed for rendering an audio program (either using speakers that are nominally equidistant from the listener, or speakers that are positioned at different distances from the listener) so that the emitted sound will be perceived as originating from sources at different distances from the listener. Such technologies include transaural sound rendering, wave-field synthesis, and active direct to reverb ratio control using dedicated loudspeaker designs. If any such technology could be implemented in a practical manner and widely deployed, it would be possible to render full 3D audio. However, until practical rendering means are available, there will be little incentive to explicitly author or distribute 3D audio content. Conversely, without 3D audio content there will be little incentive to develop and install the required rendering equipment. A means to derive 3D audio signals from traditional soundtracks to break this "chicken and egg" dilemma would be desirable. Typical embodiments of the present invention provide a solution to this problem by generating an N+M channel 3D audio program from a preexisting (e.g., conventionally generated) N-channel 2D audio program.

BRIEF DESCRIPTION OF THE INVENTION

In a class of embodiments, the invention is a method for upmixing N channel input audio (comprising N full range channels, where N is a positive integer) to generate 3D output audio comprising N+M full range channels, where M is a positive integer and the N+M full range channels are intended to be rendered by speakers including at least two speakers at different distances from the listener. Typically, the method includes steps of providing source depth data indicative of distance from the listener of at least one audio source, and upmixing the input audio to generate the 3D output audio using the source depth data. Typically, the N channel input audio is a 2D audio program whose N full range channels are intended for rendering by N speakers equidistant from the listener. In some embodiments, the 3D output audio is a 3D audio program whose N+M full range channels include N channels to be rendered by N speakers nominally equidistant from the listener (sometimes referred to as "main" speakers), and M channels intended to be rendered by additional speakers, each of the additional speakers positioned nearer or father from the listener than are the main speakers. In other embodiments, the N+M full range channels of the 3D output audio do not map to N main speakers and M additional speakers, where each of the additional speakers is positioned nearer or father from the listener than are the main speakers. For example, the output audio may be a 3D audio program including N+M full range channels to be rendered by X speakers, where X is not necessarily equal to the number of 3D audio channels in the output program (N+M) and the N+M 3D output audio channels are intended to be processed (e.g., mixed and/or filtered) to generate X speaker feeds for driving the X speakers such that a listener perceives sound emitted from the speakers as originating from sources at different distances from the listener. It is contemplated that more than one of the N+M full range channels of the 3D output audio can drive (or be processed to generate processed audio that drives) a single speaker, or one of the N+M full range channels of the 3D output audio can drive (or be processed to generate processed audio that drives) more than one speaker.

Some embodiments may include a step of generating at least one of the N+M full range channels of the 3D output audio in such a manner that said at least one of the N+M channels can drive one or more speakers to emit sound that simulates (i.e., is perceived by a listener as) sounds emitted from multiple sources at different distances from each of the speakers. Some embodiments may include a step of generating the N+M full range channels of the 3D output audio in such a manner that each of the N+M channels can drive a speaker to emit sound that is perceived by a listener as being emitted from the speaker's location. In some embodiments, the 3D output audio includes N full range channels to be rendered by N speakers nominally equidistant from the listener ("main" speakers) and M full range channels intended to be rendered by additional speakers, each of the additional speakers positioned nearer or father from the listener than are the main speakers, and the sound emitted from each of the additional speakers in response to one of said M full range channels may be perceived as being from a source nearer to the listener than are the main speakers (a nearfield source) or from a source farther from the listener than are the main speakers (a farfield source), whether or not the main speakers, when driven by the N channel input audio, would emit sound that simulates sound from such a nearfield or farfield source.

In preferred embodiments, the upmixing of the input audio (comprising N full range channels) to generate the 3D output audio (comprising N+M full range channels) is performed in an automated manner, e.g., in response to cues determined (e.g., extracted) in an automated fashion from stereoscopic 3D video corresponding to the input audio (e.g., where the input audio is a 2D audio soundtrack for the 3D video), or in response to cues determined in automated fashion from the input audio, or in response to cues determined in automated fashion from the input audio and from stereoscopic 3D video corresponding to the input audio. In this context, generation of output audio in an "automated" manner is intended to exclude generation of the output audio solely by manual mixing of channels (e.g., multiplying the channels by manually selected gain factors and adding them) of input audio (e.g., manual mixing of channels of N channel, 2D input audio to generate one or more channels of the 3D output audio).

In typical video-driven upmixing embodiments, stereoscopic information available in the 3D video is used to extract relevant audio depth-enhancement cues. Such embodiments can be used to enhance stereoscopic 3D movies, by generating 3D soundtracks for the movies. In typical audio-driven upmixing embodiments, cues for generating 3D output audio are extracted from a 2D audio program (e.g., an original 2D soundtrack for a 3D video program). These embodiments can also be used to enhance 3D movies, by generating 3D soundtracks for the movies.

In a class of embodiments, the invention is a method for upmixing N channel, 2D input audio (intended to be rendered by N speakers nominally equidistant from the listener) to generate 3D output audio comprising N+M full range channels, where the N+M channels include N full range channels to be rendered by N main speakers nominally equidistant from the listener, and M full range channels intended to be rendered by additional speakers each nearer or father from the listener than are the main speakers.

In another class of embodiments, the invention is a method for automated generation of 3D output audio in response to N channel input audio, where the 3D output audio comprises N+M full range channels, each of N and M is a positive integer, and the N+M full range channels of the 3D output audio are intended to be rendered by speakers including at least two speakers at different distances from the listener. Typically, the N channel input audio is a 2D audio program to be rendered by N speakers nominally equidistant from the listener. In this context, "automated" generation of the output audio is intended to exclude generation of the output audio solely by manual mixing of channels of the input audio (e.g., manual mixing of channels of N channel, 2D input audio to generate one or more channels of the 3D output audio). The automated generation can include steps of generating (or otherwise providing) source depth data indicative of distance from the listener of at least one audio source, and upmixing the input audio to generate the 3D output audio using the source depth data. In typical embodiments in this class, the source depth data are (or are determined from) depth cues determined (e.g., extracted) in automated fashion from stereoscopic 3D video corresponding to the input audio (e.g., where the input audio is a 2D audio soundtrack for the 3D video), or depth cues determined in automated fashion from the input audio, or depth cues determined in automated fashion from the input audio and from stereoscopic 3D video corresponding to the input audio.

The inventive method and system differs from conventional audio upmixing methods and systems (e.g., Dolby Pro Logic II, as described for example in Gundry, Kenneth, A New Active Matrix Decoder for Surround Sound, AES Conference: 19th International Conference: Surround Sound—Techniques, Technology, and Perception (June 2001)). Existing upmixers typically convert an input audio program intended for playback on a first 2D speaker configuration (e.g., stereo), and generate additional audio signals for playback on a second (larger) 2D speaker configuration that includes speakers at additional azimuth and/or elevation angles (e.g., a 5.1 configuration). The first and second speaker configurations both consist of loudspeakers that are nominally all equidistant from the listener. In contrast, upmixing methods in accordance with a class of embodiments of the present invention generate audio output signals intended for rendering by speakers physically positioned at two or more nominal distances from the listener.

Aspects of the invention include a system configured (e.g., programmed) to perform any embodiment of the inventive method, and a computer readable medium (e.g., a disc) which stores code for implementing any embodiment of the inventive method.

In typical embodiments, the inventive system is or includes a general or special purpose processor programmed with software (or firmware) and/or otherwise configured to perform an embodiment of the inventive method. In some embodiments, the inventive system is or includes a general purpose processor, coupled to receive input audio (and optionally also input video), and programmed (with appropriate software) to generate (by performing an embodiment of the inventive method) output audio in response to the input audio (and optionally also the input video). In other embodiments, the inventive system is implemented as an appropriately configured (e.g., programmed and otherwise configured) audio digital signal processor (DSP) which is operable to generate output audio in response to input audio.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system, method, and medium will be described with reference to FIGS. 1, 2, 3, and 4.

In a class of embodiments, the invention is a method for upmixing N channel input audio (where N is a positive integer) to generate 3D output audio comprising N+M full range channels, where M is a positive integer and the N+M full range channels of the 3D output audio are intended to be rendered by speakers including at least two speakers at different distances from the listener. Typically, the N channel input audio is a 2D audio program whose N full range channels are intended to be rendered by N speakers nominally equidistant from the listener.

Figure 1:
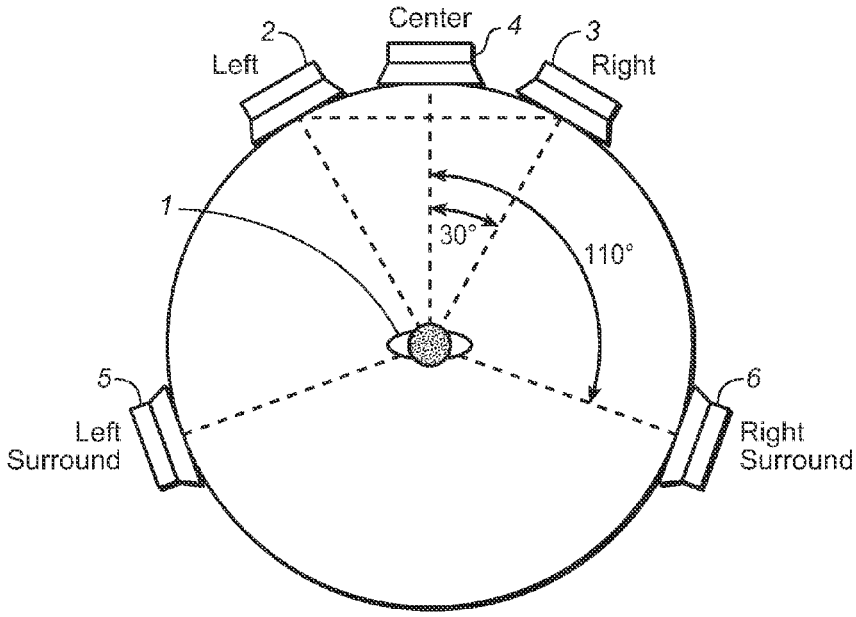
FIG. 1 (PRIOR ART)
FIG. 1 is a diagram of a conventional system for rendering 2D audio.

For example, the input audio may be a five-channel, surround sound 2D audio program intended for rendering by the conventional five-speaker system of FIG. 1 (described above). Each of the five full range channels of such a 2D audio program is intended for driving a different one of speakers 2, 3, 4, 5, and 6 of the FIG. 1 system. By upmixing such a five-channel, 2D input audio, one embodiment of the invention generates a seven-channel (N=5, M=2) 3D audio program intended for rendering by the seven-speaker system of FIG. 2. The FIG. 2 system includes speakers 2, 3, 4, 5, and 6 (identical to the identically numbered speakers of FIG. 1), and far speaker 7 (positioned at an azimuthal angle of 0 degrees relative to listener 1, but significantly farther from listener 1 than is speaker 4), and near speaker 8 (also positioned at an azimuthal angle of 0 degrees relative to listener 1, but significantly closer to listener 1 than is speaker 4). Speakers 4, 7, and 8 may be positioned at different elevations relative to listener 1. Each of the seven full range channels of the 3D audio program (generated in the exemplary embodiment) is intended for driving a different one of speakers 2, 3, 4, 5, 6, 7, and 8 of the FIG. 2 system. When so driven, the sound emitted from speakers 2, 3, 4, 5, 6, 7, and 8 will typically be perceived by listener 1 as originating from at least two sources at different distances from the listener. For example, sound from speaker 8 is perceived as originating from a nearfield source at the position of speaker 8, sound from speaker 7 is perceived as originating from a farfield source at the position of speaker 7, and sound from speakers 2, 3, 4, 5, and 6 is perceived as originating from at least one source at the same distance from listener 1 as are speakers 2, 3, 4, 5, and 6. Alternatively, sound from one subset of speakers 2, 3, 4, 5, 6, 7, and 8 simulates (i.e., is perceived by listener 1 as) sound emitted from a source at a first distance from listener 1 (e.g., sound emitted from speakers 2 and 7 is perceived as originating from a source between speakers 2 and 7, or a source farther from the listener than is speaker 7), and sound from another subset of speakers 2, 3, 4, 5, 6, 7, and 8 simulates sound emitted from a second source at another distance from listener 1.

It is not contemplated that 3D audio generated in accordance with the invention must be rendered in any specific way or by any specific system. It is contemplated that any of many different rendering methods and systems may be employed to render 3D audio content generated in accordance with various embodiments of the invention, and that the specific manner in which 3D audio is generated in accordance with the invention may depend on the specific rendering technology to be employed. In some cases, near field audio content (of a 3D audio program generated in accordance with the invention) could be rendered using one or more physical loudspeakers located close to the listener (e.g., by speaker 8 of the FIG. 2 system, or by speakers positioned between Front Channel speakers and the listener). In other cases, near field audio content (perceived as originating from a source at a distance X from the listener) could be rendered by speakers positioned nearer and/or farther than distance X from the listener (using purpose built hardware and/or software to create the sensation of near field audio), and far field audio content (of the same 3D audio program generated in accordance with the invention) could be rendered by the same speakers (which may be a first subset of a larger set of speakers) or by a different set of speakers (e.g., a second subset of the larger set of speakers).

Examples of rendering technologies that are contemplated for use in rendering 3D audio generated by some embodiments of the invention include:

binaural audio systems with near-field HRTFs rendered over headphones, transaural audio systems with near-field HRTFs, one or more simulated audio sources using wave field synthesis, one or more simulated audio sources using focused imaging, one or more overhead loudspeakers, or algorithm or device to control direct to reverb ratio.

In some embodiments, the invention is a coding method which extracts parts of an existing 2D audio program to generate an upmixed 3D audio program which when rendered by speakers is perceived as having depth effects.

Typical embodiments of the inventive method which upmix N channel input audio to generate 3D output audio (comprising N+M full range channels) employ a depth map, $D(\theta, \gamma)$ or $D(\gamma)$. The depth map describes the depth (desired perceived distance from the listener) of at least one source of sound determined by the 3D output audio, that is incident at the listener's position from a direction having azimuth, $\theta$ and elevation $\gamma$, as a function of the azimuth and elevation (or the azimuth alone). Such a depth map $D(\theta, \gamma)$ is provided (e.g., determined or generated) in any of many different ways in various embodiments of the invention. For example, the depth map can be provided with the input audio (e.g., as metadata of a type employed in some 3D broadcast formats, where the input audio is a soundtrack for a 3D video program), or from video (associated with the input audio) and a depth sensor, or from a z-buffer of a raster renderer (e.g., a GPU), or from caption and/or subtitle depth metadata included in a stereoscopic 3D video program associated with the input audio, or even from depth-from-motion estimates. When metadata is not available but stereoscopic 3D video associated with the input audio is available, depth cues may be extracted from the 3D video for use in generating the depth map. With appropriate processing, visual object distances (determined by the 3D video) can be made to correlate with the generated audio depth effects.

We next describe a preferred method for determining a depth map, $D(\theta, \gamma)$, from stereoscopic 3D video (e.g., 3D video corresponding to and provided with a 2D input audio program). We will then describe exemplary audio analysis and synthesis steps performed (in accordance with several embodiments of the inventive method) to produce 3D output audio (which will exhibit depth effects when rendered) in response to 2D input audio using the depth map.

A frame of a stereoscopic 3D video program typically determines visual objects that are perceived as being at different distances from the viewer. For example, the stereoscopic 3D video frame of FIG. 3 determines a first image for the viewer's left eye superimposed with a second image for the viewer's right eye (with different elements of first image offset from corresponding elements of the second image by different amounts). One viewing the frame of FIG. 3 would perceive an oval-shaped object determined by element L1 of the first image, and element R1 of the second image which is slightly offset to the right from element L1, and a diamond-shaped object determined by element L2 of the first image, and element R2 of the second image which is slightly offset to the left from element L2.

For each visual element of a stereoscopic 3D video program, the left and right eye frame images have disparity that varies with the perceived depth of the element. If (as is typical) a 3D image of such a program has an element at a point of zero disparity (at which there is no offset between the left eye view and right eye view of the element), the element appears at the distance of the screen. An element of the 3D image that has positive disparity (e.g., the diamond-shaped object of FIG. 3 whose disparity is +P2, which is the distance by which the left eye view L2 of the element is offset to the right from the element's right eye view R2) is perceived as being farther than (behind) the screen. Similarly, an element of the 3D image that has negative disparity (e.g., the oval-shaped object of FIG. 3 whose disparity is −P1, the distance by which the left eye view L1 of the element is offset to the left from the element's right eye view R1) is perceived as being in front of the screen.

In accordance with some embodiments of the invention, the disparity of each identified element (or at least one identified element) of a stereoscopic 3D video frame is measured and used to create a visual depth map. The visual depth map can be used directly to create an audio depth map, or the visual depth map can be offset and/or scaled and then used to create the audio depth map (to enhance the audio effects). For example, if a video scene visually occurs primarily behind the screen, the visual depth map could be offset to shift more of the audio into the room (toward the listener). If a 3D video program makes only mild use of depth (i.e., has a shallow depth "bracket") the visual depth map could be scaled up to increase the audio depth effect.

In the following example, the visual depth map, $D(\theta, \gamma)$, determined from a stereoscopic 3D video program is limited to the azimuth sector between L and R loudspeaker locations ($\theta_L$ and $\theta_R$) of a corresponding 2D audio program. This sector is assumed to be the horizontal span of the visual view screen. Also, $D(\theta, \gamma)$ values at different elevations are approximated as being the same. Thus the aim of the image analysis is to obtain:

$$D(\theta,\gamma) \approx D(\theta), \text{ where } \theta_L \leq \theta \leq \theta_R.$$

Inputs to the image analysis are the RGB matrices of each pair of left and right eye images, which are optionally downsampled for computational speed. The RGB values of the left (and right) image are transformed into Lab color space (or alternatively, another color space that approximates human vision). The color space transform can be realized in a number of well-known ways and is not described in detail herein. The following description assumes that the transformed color values of the left image are processed to generate the described saliency and region of interest (ROI) values, although alternatively these operations could be performed on the transformed color values of the right image.

Assume that for each pixel of the left image located at horizontal and vertical coordinates (x, y), we have a vector $v_{x,y}=[L_{x,y}, a_{x,y}, b_{x,y}]$ where the value $L_{x,y}$ is the Lab color space lightness value, and the values $a_{x,y}$ and $b_{x,y}$ are the Lab color space color component values.

For each pixel of the left image, a saliency measure is then calculated as $$S(x,y)=\|v_{A_1}-v_{n,m}\|+\|v_{A_2}-v_{n,m}\|+\|v_{A_3}-v_{n,m},$$

where the notation $v_{Ai}$ indicates the vector of average L, a, and b values of the pixels within region, $A_i$, of the image, and $\|v_{A_i}-v_{n,m}\|$ denotes the average of the difference between the average vector $v_{Ai}$ and the vector $V_{n,m}$ of each of the pixels in the region $A_1$ (with the indices n and m ranging over the relevant ranges for the region). In a typical embodiment, the regions $A_1$, $A_2$ and $A_3$, are square regions centered at the current pixel (x, y) with dimensions equal to 0.25, 0.125, 0.0625 times the left image height, respectively (thus, each region $A_1$ is a relatively large region, each region $A_2$ is an intermediate-size region, and each region $A_3$ is a relatively small region). The average of the differences between the average vector $v_{Ai}$ and each vector $v_{n,m}$ of the pixels in each region $A_i$ is determined, and these averages are summed to generate each value S(x,y). Further tuning of the sizes of regions $A_i$ may be applied depending on the video content. The L, a, and b values for each pixel may be further normalized by dividing them with the corresponding frame maximums so that the normalized values will have equal weights in the calculation of the saliency measure S.

Based on the saliency measures for the left image of a 3D frame, a region of interest (ROI) of the 3D image is then determined. Typically, the pixels in the ROI are determined to be those in a region of the left image in which the saliency S exceeds a threshold value τ. The threshold value can be obtained from the saliency histogram, or can be predetermined according to the video content. In practice, this step serves to separate a more static background portion (of each frame of a sequence of frames of the 3D video) from a ROI of the same frame. The ROI (of each frame in the sequence) is more likely to include visual objects that are associated with sounds from the corresponding audio program.

The evaluation of visual depth D(θ) is preferably based on a disparity calculation between left and right grayscale images, $I_L$ and $I_R$. In the exemplary embodiment, for each left image pixel (at coordinates (x,y)) in a ROI (of a frame of the 3D program) we determine a left image grayscale value $I_L$ (x,y) and also determine a corresponding right image grayscale value $I_R$ (x,y). We consider the left image grayscale values for a horizontal range of pixels that includes the pixel (i.e., those left image pixels having the same vertical coordinate y as the pixel, and having a horizontal coordinate in a range from the pixel's horizontal coordinate x to the coordinate x+δ, where δ is a predetermined value). We also consider the right image grayscale values in a range of horizontal positions offset by a candidate disparity value, d, from the pixel's horizontal coordinate, x (in other words, those pixels of the corresponding right image having the same vertical coordinate y as the left image value, and having a horizontal coordinate in a range of width δ from the left image value's offset horizontal coordinate, x+d, i.e., an x coordinate in the range from x+d to x+δ+d). We then calculate the disparity value for the pixel (using a number of different candidate disparity values d) to be:

$$D(x, y) = \underset{d}{\operatorname{argmin}} \|I_L(x : x+\delta, y) - I_R(x+d : x+\delta+d, y)\|, (x, y) \in ROI,$$

which is the value of the candidate disparity value, d, that minimizes the average of the indicated difference values $I_L-I_R$ for the pixel. The values of 8 and d can be adjusted depending on the maximum and minimum disparities ($d_{max}$ and $d_{min}$) of the video content and the desired accuracy versus the acceptable complexity of the calculation. Disparity of a uniform background is (for some video programs) equal to zero, giving a false depth indication. Thus, in order to obtain more accurate visual depth measures, a saliency calculation of the type described above is preferably performed to separate an ROI from the background. The disparity analysis is typically more computationally complex and expensive when the ROI is large than when the ROI is small. Optionally, the step of distinguishing an ROI from a background can be skipped and the whole frame treated as the ROI to perform the disparity analysis.

The determined disparity values D(x,y) (typically consisting of a disparity value for each pixel in a ROI) are next mapped to azimuthal angles to determine the depth map D(θ). The image (determined by a frame of the 3D video) is separated into azimuth sectors $\theta_i$ (each typically having width of about 3°), and an average value of disparity is calculated for each sector. E.g., the average disparity value for azimuthal sector $\theta_i$ can be the average, $D(\theta_i)$, of the disparity values D(x, y) in the intersection of the ROI with the sector. To calculate the disparity values $D(\theta_i)$ as scaled values that can be used directly in audio analysis, the average of the disparity values D(x, y) of the pixels in the intersection of the ROI with the relevant azimuthal sector $\theta_i$ may be normalized by a factor $d_n$ (usually taken as the maximum of the absolute values of $d_{max}$ and $d_{min}$ for the 3D video) and may optionally be further scaled by $a_{max}$ factor α. The scaling factor default may be α=1, but the scaling factor may depend on the desired severity of the depth effect, and on the average saliency of relevant ones of the azimuthal sectors. In case the goal is to deviate from the true visual depth mapping, e.g., by positioning the apparent source of audio corresponding to a zero-disparity video feature at a location closer to the listener than the screen, a depth bias value $d_b$ (adjusted for this purpose) can be subtracted from the normalized disparity values. Thus one may determine the disparity value $D(\theta_i)$ for the azimuthal sector $\theta_i$ (from the disparity values D(x, y) for each pixel in the intersection, $ROI_\theta$, of the ROI with the relevant azimuthal sector $\theta_i$) as $$D(\theta_i) = \alpha\frac{\overline{D(x, y)}}{d_n} - d_b, (x, y) \in ROI_\theta. \quad (1)$$

In equation (1), $\overline{D(x,y)}$ indicates the average of the disparity values D(x, y) for each pixel in the intersection of the ROI with the azimuthal sector $\theta_i$. In this way the depth map D(θ) (the disparity values $D(\theta_i)$ of equation (1) for all the azimuthal sectors) can be calculated as a set of scale measures that change linearly with the visual distance for each azimuth sector.

The map D(θ) determined from equation (1) (an "unmodified" map) is typically modified for use in generating near-channel or far-channel audio, because negative values of the unmodified map D(θ) indicate positive near-channel gain, and positive values thereof indicate far-channel gain. For example, a first modified map is generated for use to generate near-channel audio, and a second modified map is generated for use to generate far-channel audio, with positive values of the unmodified map replaced in the first modified map by values indicative of zero gain (rather than negative gain) and negative values of the unmodified map replaced in the first modified map by their absolute values, and with negative values of the unmodified map replaced in the second modified map by values indicative of zero gain (rather than negative gain).

When the determined map D(θ), either modified (e.g., as indicated above) or unmodified, is used as an input for 3D audio generation it is considered to be indicative of a relative measure of audio source depth. It can thus be used to generate "near" and/or "far" channels (of a 3D audio program) from input 2D audio. In generating the near and/or far channels, it is typically assumed that the near and/or far audio channel rendering means (e.g., far speaker(s) positioned relatively near to the listener and/or near speaker(s) positioned relatively near to the listener) will be level calibrated appropriately with the "main" audio channel rendering means (e.g., speakers positioned nominally equidistant from the listener at a distance nearer than is each far speaker and farther than is each near speaker) to be used for rendering each "main" audio channel.

Figure 2:
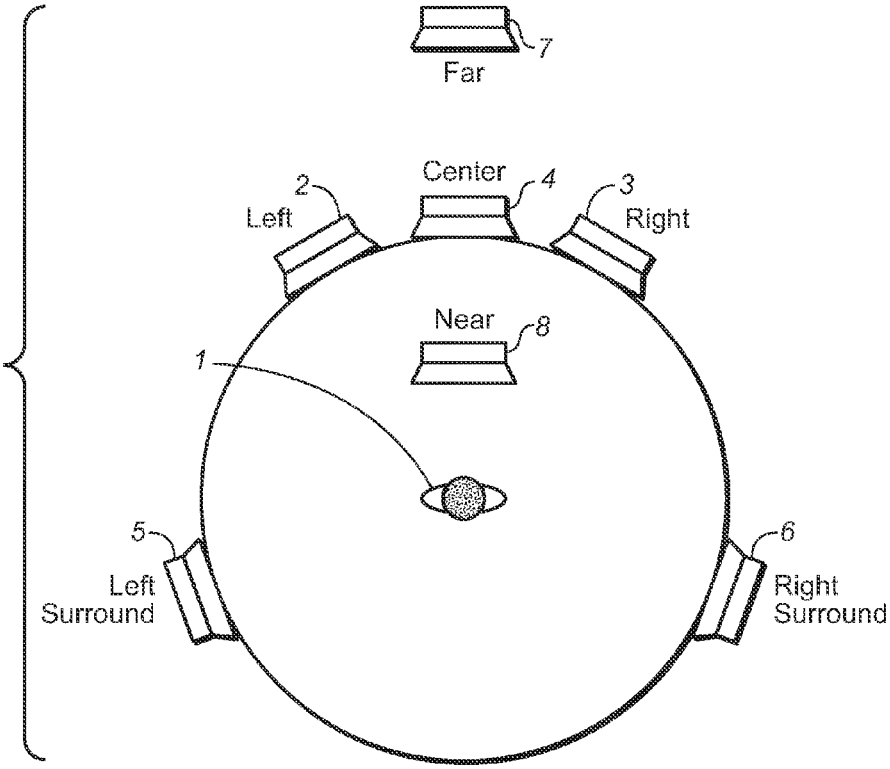
FIG. 2 is a diagram of a system for rendering 3D audio (e.g., 3D audio generated in accordance with an embodiment of the invention).
Figure 3:
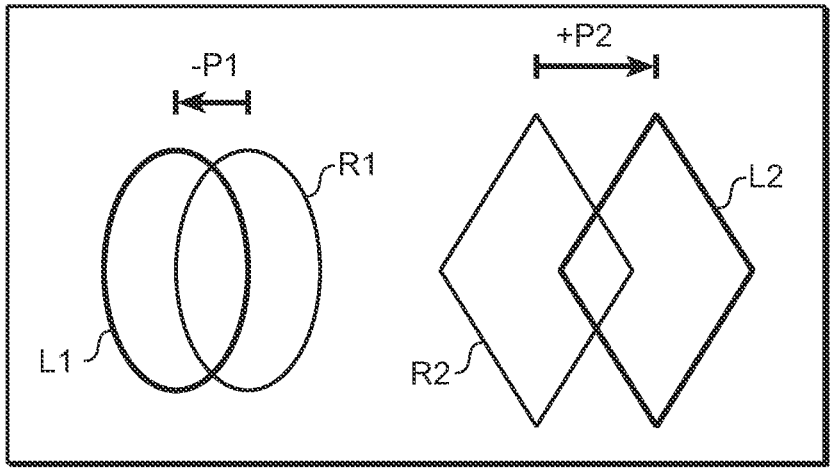
FIG. 3 is a frame of a stereoscopic 3D video program, showing a first image for the viewer's left eye superimposed with a second image for the viewer's right eye (with different elements of first image offset from corresponding elements of the second image by different amounts).

Typically, it is desired that the rendered near/far channel audio signals will be perceived as emerging from the frontal sector (e.g., from between Left front and Right front speaker locations of a set of speakers for rendering surround sound, such as from between left speaker 2 and right speaker 3 of the FIG. 2 system). Also, if the map D(θ) is calculated as described above, it is natural to generate the "near" and/or "far" channels from only the front channels (e.g., L, R, and C) of an input 2D audio soundtrack (for a video program) since the view screen is assumed to span the azimuth sector between the Left front (L) and Right front (R) speakers.

In embodiments of the inventive method in which video program analysis is performed (e.g., to determine a depth map for generating "near" and/or "far" audio channels of a 3D audio program) as well as audio analysis, the audio analysis is preferably performed in frames that correspond temporally with the video frames. A typical embodiment of the inventive method first converts the frame audio (of the front channels of 2D input audio) to the frequency domain with an appropriate transform (e.g., a short-term Fourier transform, sometimes referred to as "STET"), or using a complex QMF filter bank to provide frequency modification robustness that may be required for some applications. In the following example, $X_j$ (b,t) indicates a frequency domain representation of a frequency band, b, of a channel j of a frame of input audio (identified by time t), and $X_s$ (b,t) indicates a frequency domain representation of the sum of the front channels of an input audio frame (identified by the time t) in the frequency band b.

In the frequency domain, an average gain value $g_j$ is determined for each front channel of the input audio (for each frequency band of each input audio frame) as the temporal mean of band absolute values. For example, one can so calculate the average gain value $g_L$ for the Left channel of an input 5.1 surround sound 2D program, the average gain value $g_R$ for the program's Right channel, and the average gain value $g_c$ for the program's Center channel, for each frequency band of each frame of the input audio, and construct the matrix $[g_L, g_C, g_R]$. This makes it possible to calculate an overall azimuth direction vector as a function of frequency for the current frame:

$$\theta_{tot}(b,t)=[g_L g_C g_R]L,$$

where L is a 3×2 matrix containing standard basis unit-length vectors pointing towards each of the front loudspeakers. Alternatively, coherence measures between the channels can also be used when determining $\theta_{tot}$(b,t).

In the example, the azimuthal region between the L and R speakers is divided into sectors that correspond to the information given by the depth map D(θ). The audio for each azimuth sector is extracted using a spatially smooth mask given by:

$$M(\theta, b, t) = e^{\left(\frac{|\theta_{tot}(b,t)-\theta|^2}{\sigma}\right)}, \tag{2}$$

where σ is a constant controlling the spatial width of the mask.

Next, a near channel signal can be calculated by multiplying the sum of front channels ($X_s$ (b, t)) by the mask (of equation (2)) and depth map values for each azimuth sector, and summing over all azimuth sectors:

$$Y(b, t) = \sum_{\theta} D_n(\theta) \cdot M(\theta, b, t) \cdot X_s(b, t), \tag{3}$$

where Y(b,t) in equation (3) is the near channel audio value in frequency band b in the near channel audio frame (identified by time t), and the map $D_n(\theta)$ in equation (3) is the depth map determined from equation (1), modified to replace its positive values by zeroes and its negative values by their absolute values.

Also, a far channel signal is calculated by multiplying the sum of front channels ($X_s$ (b,t)) by the mask (of equation (2)) and depth map values for each azimuth sector, and summing over all azimuth sectors:

$$Y(b, t) = \sum_{\theta} D_f(\theta) \cdot M(\theta, b, t) \cdot X_s(b, t), \tag{4}$$

where Y(b,t) in equation (4) is the far channel audio value in frequency band b in the far channel audio frame (identified by time t), and the map $D_f(\theta)$ in equation (4) is the depth map determined from equation (1), modified to replace its negative values by zeroes.

Although the scaled audio from different azimuth sectors is summed in each of equations (3) and (4) to a mono signal, it is possible to omit the summing (in equations (3) and (4)) to determine multiple output channels, $Y_n(\theta,b,t)=D_n(\theta)\cdot M(\theta,b,t)\cdot X_S(b,t)$ and $Y_f(\theta,b,t)=D_f(\theta)\cdot M(\theta,b,t)\cdot X_S(b,t)$ that represent the audio of different azimuth subsectors, for each of the near and far channels.

The content of the near channel (determined by the Y(b, t) values of equation (3)) and/or the content of the far channel (determined by the Y(b, t) values of equation (4)) may be removed from the front main channels (of the 3D audio generated in accordance with the invention) either according to a power law:

$$X'_j(b,t) = X_j(b,t)\cdot\sqrt{1-\left(\sum_{\theta} D(\theta)\cdot M(\theta,b,t)\right)^2}, \tag{5}$$

or according to a linear law:

$$X'_j(b,t) = X_j(b,t)\cdot\left(1-\left(\sum_{\theta} D(\theta)\cdot M(\theta,b,t)\right)\right). \tag{6}$$

As a final processing step, all frequency domain frame signals (of the generated near channel and far channel) are converted back to the time domain, to generate the time domain near channel signal and the time domain far channel signal of the output 3D audio. The output 3D audio also includes "main" channels which are the full range channels (L, R, C and typically also LS and RS) of the unmodified input 2D audio, or of a modified version of the input 2D audio (e.g., with its L, R, and C channels modified as a result of an operation as described above with reference to equation (5) or equation (6)).

Other embodiments of the inventive method upmix 2D audio (e.g., the soundtrack of a 3D video program) also generate 3D audio using cues derived from a stereoscopic 3D video program corresponding to the 2D audio. The embodiments typically upmix N channel input audio (comprising N full range channels, where N is a positive integer) to generate 3D output audio comprising N+M full range channels, where M is a positive integer and the N+M full range channels are intended to be rendered by speakers including at least two speakers at different distances from the listener, including by identifying visual image features from the 3D video and generating cues indicative of audio source depth from the image features (e.g., by estimating or otherwise determining the depth cues for image features that are assumed to be audio sources).

The methods typically include steps of comparing left eye images and corresponding right eye images of a frame of the 3D video (or a sequence of 3D video frames) to estimate local depth of at least one visual feature, and generating cues indicative of audio source depth from the local depth of at least one identified visual feature that is assumed to be an audio source. In variations on the above-described embodiment for generating a depth map, the image comparison may use random sets of robust features (e.g., surf) determined by the images, and/or color saliency measures to separate the pixels in a region of interest (ROI) from background pixels and to calculate disparities for pixels in the ROI. In some embodiments, predetermined 3D positioning information included in or with a 3D video program (e.g., subtitle or closed caption, z-axis 3D positioning information provided with the 3D video) is used to determine depth as a function of time (e.g., frame number) of at least one visual feature of the 3D video program.

The extraction of visual features from the 3D video can be performed in any of various ways and contexts, including: in post production (in which case visual feature depth cues can be and stored as metadata in the audiovisual program stream (e.g., in the 3D video or in a soundtrack for the 3D video) to enable post-processing effects (including subsequent generation of 3D audio in accordance with an embodiment of the present invention), or in real-time (e.g., in an audio video receiver) from 3D video lacking such metadata, or in non-real-time (e.g., in a home media server) from 3D video lacking such metadata.

Typical methods for estimating depth of a visual feature of a 3D video program includes a step of creating a final visual image depth estimate for a 3D video image (or for each of a number of spatial regions of the 3D video image) as an average of local depth estimates (e.g., where each of the local depth estimates indicates visual feature depth within a relatively small ROI). The averaging can be done spatially over regions of a 3D video image in one of the following ways: by averaging local depth estimates across the entire screen (i.e., the entire 3D image determined by a 3D video frame), or by averaging local depth estimates across a set of static spatial subregions (e.g., left/center/right regions of the entire 3D image) of the entire screen (e.g., to generate a final "left" visual image depth for a subregion on the left of the screen, a final "center" visual image depth for a central subregion of the screen, and a final "right" visual image depth for a subregion on the right of the screen), or by averaging local depth estimates across a set of dynamically varying spatial subregions (of the entire screen), e.g., based on motion detection, or local depth estimates, or blur/focus estimates, or audio, wideband (entire audio spectrum) or multiband level and correlation between channels (panned audio position). Optionally, a weighted average is performed according to at least one saliency metric, such as, for example, screen position (e.g., to emphasize the distance estimate for visual features at the center of the screen) and/or image focus (e.g. to emphasize the distance estimate for visual images that are in focus). The averaging can be done temporally over time intervals of the 3D video program in any of several different ways, including the following: no temporal averaging (e.g. the current depth estimate for each 3D video frame is used to generate 3D audio), averaging over fixed time intervals (so that a sequence of averaged depth estimates is used to generate the 3D audio), averaging over dynamic time intervals determined (solely or in part) by analysis of the video, or averaging over dynamic time intervals determined (solely or in part) by analysis of the input audio (soundtrack) corresponding to the video.

In embodiments of the inventive method that use visual feature depth information derived from a stereoscopic 3D video program to upmix 2D input audio (e.g., the soundtrack of the video program) to generate 3D audio, the feature depth information can be correlated with the 3D audio in any of a variety of ways. In some embodiments, for each near (or far) channel of the 3D output audio that corresponds to a spatial region (relative to the listener), audio from at least one channel of the 2D input audio channel is associated with a visual feature depth and assigned to a near (or far) channel of the 3D output audio using one or more of the following methods:

all or part of the content of at least one channel of the 2D input audio (e.g., a mix of content from two channels of the input audio) that corresponds to a spatial region is assigned to a near channel of the 3D audio (to be rendered so as to be perceived as emitting from the spatial region) if the estimated depth is less than an intermediate depth, and all or part of the content of at least one channel of the 2D input audio that corresponds to the spatial region is assigned to a far channel of the 3D audio (to be rendered so as to be perceived as emitting from the spatial region) if the estimated depth is greater than the intermediate depth (e.g. content of a left channel of the input audio is mapped to a "left" near channel, to be rendered so as to be perceived as emitting from a left spatial region, if the estimated depth is less than the intermediate depth); or pairs of channels of the input audio are analyzed (on a wideband or per frequency band basis) to determine an apparent audio image position for each pair, and all or part of the content of a pair of the channels is mapped to a near channel of the 3D audio (to be rendered so as to be perceived as emitting from a spatial region including the apparent audio image position) if the estimated depth is less than an intermediate depth, and all or part of the content of a pair of the channels is mapped to a far channel of the 3D audio (to be rendered so as to be perceived as emitting from a spatial region including the apparent audio image position) if the estimated depth is greater than the intermediate depth; or pairs of channels of the input audio are analyzed (on a wideband or per frequency band basis) to determine apparent audio image cohesion for each pair (typically based on degree of correlation), and all or part of the content of a pair of the channels is mapped to a near channel of the 3D audio (to be rendered so as to be perceived as emitting from an associated spatial region) if the estimated depth is less than an intermediate depth, and all or part of the content of a pair of the channels is mapped to a far channel of the 3D audio (to be rendered so as to be perceived as emitting from an associated spatial region) if the estimated depth is greater than the intermediate depth, where the portion of content to be mapped is determined in part by the audio image cohesion.

Each of these techniques can be applied over an entire 2D input audio program. However, it will typically be preferable to assign audio from at least one channel of a 2D input audio program to near and/or far channels of the 3D output audio over time intervals and/or frequency regions of the 2D input audio program.

In some embodiments of the inventive method that upmix 2D input audio (e.g., the soundtrack of a 3D video program) to generate 3D output audio using depth information derived from a stereoscopic 3D video program that corresponds to the 2D audio, a near (or far) channel of the 3D audio signal is generated as follows using the determined visual depth information. Once visual feature depth (for a spatial region) has been determined, content of one (or more than one) channel of the 2D input audio is assigned to a near channel of the 3D audio (to be rendered so as to be perceived as emitting from an associated spatial region) if the depth is greater than a predetermined threshold value, and the content is assigned to a far channel of the 3D audio (to be rendered so as to be perceived as emitting from an associated spatial region) if the depth is greater than a predetermined second threshold value. In some embodiments, if a visual feature depth estimate increases over time (for a spatial region) from a value below a threshold value to approach the threshold value, the main channels of the 3D output audio are generated so as to include audio content of input audio channel(s) having increasing average level (e.g., content that has been amplified with increasing gain), and optionally also at least one near channel of the 3D output audio (to be rendered so as to be perceived as emitting from an associated spatial region) is generated so as to include audio content of such input audio channel(s) having decreasing average level (e.g., content that has been amplified with decreasing gain), to create the perception (during rendering of the 3D audio) that the source is moving away from the listener.

Such determination of near (or far) channel content using determined visual feature depth information can be performed using visual feature depth information derived from an entire 2D input audio program. However, it will typically be preferable to compute visual feature depth estimates (and to determine the corresponding near or far channel content of the 3D output audio) over time intervals and/or frequency regions of the 2D input audio program.

After creation of 3D output audio in accordance with any embodiment of the invention, the 3D output audio channels can (but need not) be normalized. One or more of the following normalization methods may be used to do so: no normalization, so that some 3D output audio channels (e.g., "main" output audio channels) are identical to corresponding input audio channels (e.g., "main" input audio channels), and generated "near" and/or "far" channels of the output audio are generated in any of the ways described herein without application thereto of any scaling or normalization; or linear normalization (e.g., total output signal level is normalized to match total input signal level, for example, so that 3D output signal level summed over N+M channels matches the 2D input signal level summed over its N channels), or power normalization (e.g., total output signal power is normalized to match total input signal power).

In another class of embodiments, of the inventive method, upmixing of 2D audio (e.g., the soundtrack of a video program) to generate 3D audio is performed using the 2D audio only (not using video corresponding thereto).

For example, a common mode signal can be extracted from each of at least one subset of the channels of the 2D audio (e.g. from L and Rs channels of the 2D audio, and/or from R and Ls channels of the 2D audio), and all or a portion of each common mode signal is assigned to each of at least one near channel of the 3D audio. The extraction of a common mode signal can be performed by a 2 to 3 channel upmixer using any algorithm suitable for the specific application (e.g., using the algorithm employed in a conventional Dolby Pro Logic upmixer in its 3 channel (L, C, R) output mode), and the extracted common mode signal (e.g., the center channel C generated using a Dolby Pro Logic upmixer in its 3 channel (L, C, R) output mode) is then assigned (in accordance with the present invention) to a near channel of a 3D audio program.

Other exemplary embodiments of the inventive method use a two-step process to upmix 2D audio to generate 3D audio (using the 2D audio only; not video corresponding thereto). Specifically, the embodiments upmix N channel input audio (comprising N full range channels, where N is a positive integer) to generate 3D output audio comprising N+M full range channels, where M is a positive integer and the N+M full range channels are intended to be rendered by speakers including at least two speakers at different distances from the listener, and include steps of: estimating audio source depth from the input audio; and determining at least one near (or far) audio channel of the 3D output audio using the estimated source depth.

For example, the audio source depth can be estimated as follows by analyzing channels of the 2D audio. Correlation between each of at least two channel subsets of the 2D audio (e.g. between L and Rs channels of the 2D audio, and/or between R and Ls channels of the 2D audio) is measured, and a depth (source distance) estimate is assigned based on the correlation such that a higher correlation results in a shorter depth estimate (i.e., an estimated position, of a source of the audio, that is closer to the listener than the estimated position that would have resulted if there were lower correlation between the subsets).

For another example, the audio source depth can be estimated as follows by analyzing channels of the 2D audio. The ratio of direct sound level to reverb level indicated by one or more channels of the 2D audio is measured, and a depth (source distance) estimate is assigned such that audio with a higher ratio of direct to reverb level is assigned a shorter depth estimate (i.e., an estimated position, of a source of the audio, that is closer to the listener than the estimated position that would have resulted if there were a lower ratio of direct to reverb level for the channels).

Any such audio source depth analysis can be performed over an entire 2D audio program. However, it will typically be preferable to compute the source depth estimates over time intervals and/or frequency regions of the 2D audio program.

Once audio source depth has been estimated, the depth estimate derived from a channel (or set of channels) of the input audio can be used to determine at least one near (or far) audio channel of the 3D output audio. For example, if the depth estimate derived from a channel (or channels) of 2D input audio is less than a predetermined threshold value, the channel (or a mix of the channels) is assigned to a near channel (or to each of a set of near channels) of the 3D output audio (and the channel(s) of the input audio are also used as main channel(s) of the 3D output audio), and if the depth estimate derived from a channel (or channels) of 2D input audio is greater than a predetermined second threshold value, the channel (or a mix of the channels) is assigned to a far channel (or to each of a set of far channels) of the 3D output audio (and the channel(s) of the input audio are also used as main channel(s) of the 3D output audio). In some embodiments, if a depth estimate increases for a channel (or channels) of the input audio from a value below a threshold value to approach the threshold value, the main channels of the 3D output audio are generated so as to include audio content of such input audio channel(s) having increasing average level (e.g., content that has been amplified with increasing gain), and optionally also a near channel (or channels) of the 3D output audio are generated so as to include audio content of such input audio channel(s) having decreasing average level (e.g., content that has been amplified with decreasing gain), to create the perception (during rendering) that the source is moving away from the listener.

Such determination of near (or far) channel content using estimated audio source depth can be performed using estimated depths derived from an entire 2D input audio program. However, it will typically be preferable to compute the depth estimates (and to determine the corresponding near or far channel content of the 3D output audio) over time intervals and/or frequency regions of the 2D input audio program.

It is contemplated that some embodiments of the inventive method (for upmixing of 2D input audio to generate 3D audio) will be implemented by an AVR using depth metadata (e.g., metadata indicative of depth of visual features of a 3D video program associated with the 2D input audio) extracted at encoding time and packaged (or otherwise provided) with the 2D input audio (the AVR could include a decoder or codec that is coupled and configured to extract the metadata from the input program and to provide the metadata to an audio upmixing subsystem of the AVR for use in generating the 3D output audio). Alternatively, additional near-field (or near-field and far-field) PCM audio channels (which determine near channels or near and far channels of a 3D audio program generated in accordance with the invention) can be created during authoring of an audio program, and these additional channels provided with an audio bitstream that determines the channels of a 2D audio program (so that these latter channels can also be used as "main" channels of a 3D audio program).

In typical embodiments, the inventive system is or includes a general or special purpose processor programmed with software (or firmware) and/or otherwise configured to perform an embodiment of the inventive method. In other embodiments, the inventive system is implemented by appropriately configuring (e.g., by programming) a configurable audio digital signal processor (DSP) to perform an embodiment of the inventive method. The audio DSP can be a conventional audio DSP that is configurable (e.g., programmable by appropriate software or firmware, or otherwise configurable in response to control data) to perform any of a variety of operations on input audio data.

Figure 4:
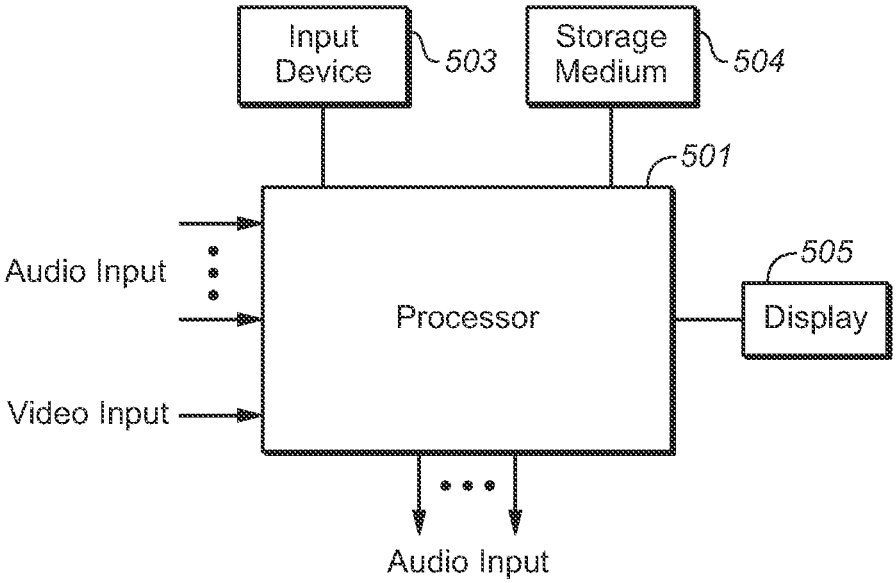
FIG. 4 is a block diagram of a computer system, including a computer readable storage medium 504 which stores computer code for programming processor 501 of the system to perform an embodiment of the inventive method.

In some embodiments, the inventive system is a general purpose processor, coupled to receive input data (input audio data, or input video data indicative of a stereoscopic 3D video program and audio data indicative of an N-channel 2D soundtrack for the video program) and programmed to generate output data indicative of 3D output audio in response to the input data by performing an embodiment of the inventive method. The processor is typically programmed with software (or firmware) and/or otherwise configured (e.g., in response to control data) to perform any of a variety of operations on the input data, including an embodiment of the inventive method. The computer system of FIG. 4 is an example of such a system. The FIG. 4 system includes general purpose processor 501 which is programmed to perform any of a variety of operations on input data, including an embodiment of the inventive method.

The computer system of FIG. 4 also includes input device 503 (e.g., a mouse and/or a keyboard) coupled to processor 501, storage medium 504 coupled to processor 501, and display device 505 coupled to processor 501. Processor 501 is programmed to implement the inventive method in response to instructions and data entered by user manipulation of input device 503. Computer readable storage medium 504 (e.g., an optical disk or other tangible object) has computer code stored thereon that is suitable for programming processor 501 to perform an embodiment of the inventive method. In operation, processor 501 executes the computer code to process data indicative of input audio (or input audio and input video) in accordance with the invention to generate output data indicative of multi-channel 3D output audio. A conventional digital-to-analog converter (DAC) could operate on the output data to generate analog versions of the audio output channels for rendering by physical speakers (e.g., the speakers of the FIG. 2 system).

Aspects of the invention are a computer system programmed to perform any embodiment of the inventive method, and a computer readable medium which stores computer-readable code for implementing any embodiment of the inventive method.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for generating 3D output audio comprising N+M full range channels, where N and M are positive integers and the N+M full range channels are intended to be rendered by speakers including at least two speakers at different distances from a listener, said method including the steps of:

(a) providing N channel input audio, comprising N full range channels;

(b) upmixing the input audio to generate the 3D output audio, and (c) providing source depth data indicative of distance from the listener of at least one audio source, wherein step (b) includes a step of upmixing the N channel input audio to generate the 3D output audio using the source depth data, wherein the N channel input audio is a soundtrack of a stereoscopic 3D video program comprising left and right eye frame images, and step (c) includes generating the source depth data, including by identifying at least one visual image feature determined by the 3D video program, and generating the source depth data to be indicative of determined depth of each said visual image feature, wherein generating the source depth data comprises measuring a disparity of the least one visual image feature of the left and right eye frame images, using the disparity to create a visual depth map, and using the visual depth map to generate the source depth data.

2. The method of claim 1, wherein the audio source is a source of sound determined by the 3D output audio that is incident at the listener from a direction having a first azimuth and a first elevation relative to the listener, the depth of the visual image feature determines the distance of the audio source from the listener, and the depth data is indicative of the distance of the audio source from the listener as a function of azimuth and elevation.

3. The method of claim 1, wherein the audio source is a source of sound determined by the 3D output audio that is incident at the listener from a direction having a first azimuth relative to the listener, the depth of the visual image feature determines the distance of the audio source from the listener, and the depth data is indicative of the distance of the audio source from the listener as a function of azimuth.

4. The method of claim 1, wherein the N channel input audio is a 2D audio program.

5. The method of claim 1, wherein the N channel input audio is a 2D audio program, and the N full range channels of the 2D audio program are intended for rendering by N speakers nominally equidistant from the listener.

6. The method of claim 1, wherein the 3D output audio is a 3D audio program and the N+M full range channels of the 3D audio program include N channels to be rendered by N main speakers nominally equidistant from the listener, and M channels intended to be rendered by additional speakers, each of the additional speakers positioned nearer or father from the listener than are the main speakers.

7. The method of claim 1, wherein step (c) includes the step of generating the source depth data in automated fashion from the N channel input audio.

8. The method of claim 1, wherein the disparity of the least one visual image feature of the left and right eye frame images is measured using left and right eye frame grayscale images.

9. A system including a processor coupled to receive input data indicative of N channel input audio comprising N full range channels, wherein the processor is configured to generate output data by processing the input data in such a manner as to upmix the input audio and cause the output data to be indicative of 3D audio comprising N+M full range channels, where N and M are positive integers and the N+M full range channels are intended to be rendered by speakers including at least two speakers at different distances from a listener, wherein the processor is configured to process the input data and source depth data to generate the output data, wherein the source depth data are indicative of distance from the listener of at least one audio source, wherein the N channel input audio is a soundtrack of a stereoscopic 3D video program comprising left and right eye frame images, and the processor is configured to generate the source depth data, including by identifying at least one visual image feature determined by the 3D video program and generating the source depth data to be indicative of determined depth of each said visual image feature;

wherein generating the source depth data comprises measuring a disparity of the least one visual image feature of the left and right eye frame images, using the disparity to create a visual depth map, and using the visual depth map to generate the source depth data.

10. The system of claim 9, wherein the audio source is a source of sound determined by the 3D audio that is incident at the listener from a direction having a first azimuth and a first elevation relative to the listener, the depth of the visual image feature determines the distance of the audio source from the listener, and the depth data is indicative of the distance of the audio source from the listener as a function of azimuth and elevation.

11. The system of claim 9, wherein the N channel input audio is a 2D audio program.

12. The system of claim 9, wherein the N channel input audio is a 2D audio program and the N full range channels of the 2D audio program are intended for rendering by N speakers nominally equidistant from the listener.

13. The system of claim 9, wherein the 3D audio is a 3D audio program and the N+M full range channels of the 3D audio program include N channels to be rendered by N main speakers nominally equidistant from the listener, and M channels intended to be rendered by additional speakers, each of the additional speakers positioned nearer or father from the listener than are the main speakers.

14. The system of claim 9, wherein said system is an audio digital signal processor.

15. The system of claim 9, wherein the processor is a general purpose processor that has been programmed to generate the output data in response to the input data.

* * * * *